US005539511A

United States Patent [19]

Wenthe, Jr. et al.

[11] Patent Number: 5,539,511

[45] Date of Patent: Jul. 23, 1996

[54] MULTILEVEL/DUPLEX IMAGE SHEET DECURLING APPARATUS

[75] Inventors: Stephen J. Wenthe, Jr., West Henrietta; Ashok T. Patel, Webster; Arthur J. Sobon; Bruce J. DiRenzo, both of Rochester; Kenneth E. Giunta, Penfield; David G. Kolbe, Rochester; Thomas R. Alexander, Webster; Carlos A. Velazquez, Walworth, all of N.Y.

[73] Assignee: Xerox Corporation, Stamford, Conn.

[21] Appl. No.: 357,795

[22] Filed: Dec. 16, 1994

[51] Int. Cl.[6] ..... G03G 21/00

[52] U.S. Cl. ..... 355/309; 162/270

[58] Field of Search ..... 355/282, 308, 355/309; 271/188, 209; 162/270, 271; 493/459; 219/216

[56] References Cited

U.S. PATENT DOCUMENTS

| | | | |
|---|---|---|---|
| 1,969,073 | 8/1934 | Hamre . | |
| 4,326,915 | 4/1982 | Mutschler, Jr. | 162/271 |
| 4,475,896 | 10/1984 | Bains | 493/454 |
| 4,505,695 | 3/1985 | Billings | 493/459 |
| 4,539,072 | 9/1985 | Frye et al. | 162/197 |
| 4,591,259 | 5/1986 | Kuo et al. | 355/309 |
| 4,627,718 | 12/1986 | Wyer | 355/311 |
| 4,632,533 | 12/1986 | Young | 355/309 |
| 4,892,994 | 1/1990 | Tsuchiya et al. | 219/216 |
| 4,926,358 | 5/1990 | Tani et al. | 364/562 |
| 4,952,281 | 8/1990 | Akira | 162/270 |
| 5,084,731 | 1/1992 | Baruch | 355/208 |
| 5,201,514 | 4/1993 | Rebres | 271/188 |
| 5,202,737 | 4/1993 | Hollar | 355/308 |
| 5,287,157 | 2/1994 | Mujazato et al. | 355/309 |

*Primary Examiner*—William J. Royer
*Attorney, Agent, or Firm*—Don L. Webber

[57] ABSTRACT

A sheet decurler such as may be used to decurl liquid or solid toned printed or copied sheets. The decurler has an extended multidirectional nip having first and second decurling members for removing multiple curl conditions from a sheet.

25 Claims, 9 Drawing Sheets

MULTILEVEL/DUPLEX IMAGE SHEET DECURLING APPARATUS

The present invention relates to a decurler for developed and fused sheets output by an electronic reprographic image forming apparatus, and more particularly to a decurler for decurling duplex and multilayer/color toned sheets.

In electrophotographic applications such as xerography, a charge retentive photoreceptor belt is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to record an electrostatic latent image on the photoreceptor. In a light lens copier, the photoreceptor may be exposed to a pattern of light or obtained from the original image to be reproduced. In each case, the resulting pattern of charged and discharged areas on the photoreceptor form an electrostatic charge pattern (an electrostatic latent image) conforming to the original image.

The electrostatic image on the photoreceptor may be developed by contact with a finely divided electrostatically attractable toner. The toner is held in position on the photoreceptor image areas by the electrostatic charge on the surface. Thus, a toner image is produced in conformity with a light image of the original being reproduced. Once each toner image is transferred to a substrate, the image is affixed thereto so as to form a permanent record of the image to be reproduced. After a toned image is fused to the sheet, particularly when duplex or multiple layer/color printing (up to four or more layers of toner fused to the sheet), mild to severe sheet curling can occur. Single or multiple layers of toner may be applied to a substrate in creating the simplex, duplex or multicolor copy or print. Depending on the (widely varying) nature of the substrate (print/copy) sheets (plain paper, cover stock, synthetic/plastic materials) the task of decurling the sheet can be very difficult to manage and perform. Known adjustable or fixed decurling systems may be ineffective to combat varying directions and degrees of curl that can switch directions across the surface of a duplex or simplex copy.

Sheet curling also causes problems of handling as the sheet is processed in the printing machine. Sheets delivered in a curled condition have a tendency to have their edges out of registration with the aligning mechanisms and other sheet moving systems employed in the printing machine. In addition, curled sheets tend to frequently produce jams or misfeeds within the printing machine, or in upstream/downstream subsystems, especially input or output sorting, stacking, collating, compiling and/or other sheet handling systems. Belts or soft rollers may be used in conventional decurlers in which one or more paper paths are effective in reducing paper curls primarily in one direction, and are less if not ineffective in decurling duplex and/or or other non-uniform sheet curl conditions.

Various approaches have been employed to decurl sheets, including the following disclosures which may be relevant:

U.S. Pat. No. 5,287, 157
Patentee: Miyazato
Issued: Feb. 15, 1994
U.S. Pat. No. 5,202,737
Patentee: Hollar Issued: Apr. 13, 1993
U.S. Pat. No. 5,201,514
Patentee: Rebres
Issued: Apr. 13, 1993
U.S. Pat. No. 5,084,731
Patentee: Baruch
Issued: Apr. 13, 1993
U.S. Pat. No. 4,952,281
Patentee: Akira
Issued: Aug. 28, 1990
U.S. Pat. No. 4,926,358
Patentee: Tani et al.
Issued: May 15, 1990
U.S. Pat. No. 4,632,533
Patentee: Young
Issued: Dec. 30, 1986
U.S. Pat. No. 4,627,718
Patentee: Wyer
Issued: Dec. 9, 1986
U.S. Pat. No. 4,591,259
Patentee: Kuo et al.
Issued: May 27, 1986
U.S. Pat. No. 4,505,695
Patentee: Billings
Issued: Mar. 19, 1985
U.S. Pat. No. 4,475,896
Patentee: Bains
Issued: Oct. 9, 1984
U.S. Pat. No. 4,539,072
Patentee: Frye et al.
Issued: Sep. 3, 1985
U.S. Pat. No. 1,969,073
Patentee: Hamre
Issued: Aug. 7, 1934

The pertinent portions of the foregoing disclosures may be briefly summarized as follows:

U.S. Pat. No. 5,284,157 discloses a decurler including a depressing roll pushed against a belt positionable to contact a sheet passing therebetween. The decurler further includes a mechanism for adjusting the position of the depressing roll.

U.S. Pat. No. 5,202,737 discloses a decurler having a rod for deflecting a belt to define a nip therebetween. The belt is entrained about a pair of spaced rollers. A pair of baffle plates are located at the entrance to the nip and at the exit to the nip. The rod is adapted to move in a vertical direction so as to vary the degree of deflection and the bend of the sheet. The baffle plates at both the exit and entrance regions to the nip pivot in unison with the translation of the pivot rod so as to adjust the orientation of the sheet entering and leaving the nip.

U.S. Pat. No. 5,201,514 discloses a decurler including a decurler shaft and a first belt positionable to contact an arcuate portion of the decurler shaft; a second belt is also included, and is positionable to contact the first belt and to bend around the arcuate portion of the decurler shaft. The decurler further includes a mechanism for advancing the sheet between the first belt and the second belt so as to bend the sheet around the arcuate portion of the decurler shaft.

U.S. Pat. No. 5,084,731 discloses a sheet decurling mechanism which detects sheet curl before it enters a decurler. Two selectable decurling paths are provided, depending upon the direction of curl.

U.S. Pat. No. 4,952,281 discloses a sheet decurling control apparatus having a decurler bar applied between a pair of backup rollers. The decurling system can adjust the decurler bar sheet wrap angle by displacing the backup rollers.

U.S. Pat. No. 4,926,358 describes a decurling system that measures the direction and size of a sheet curl and then varies the curling force and direction accordingly.

U.S. Pat. No. 4,632,533 discloses a sheet decurler having two paths. A pair of offset rollers are located in each path with the nip being positioned to cause the sheet to bend as it passes therethrough. The offset nip in combination with the output baffle reverse bends the sheet.

U.S. Pat. No. 4,627,718 discloses a sheet curl control apparatus having a pair of rollers in engagement with one another. A set of baffle plates is located at the entrance and exit of the nip defined by the rollers. The sheet is advanced to and from the nip by the baffle plates at an angle so as to cause the sheet to bend as it passes through the nip.

U.S. Pat. No. 4,591,259 discloses a decurler in which a sheet moving therethrough chooses one of three paths. Spring loaded baffles, in conjunction with idler rolls, reverse bend the sheets in two of the three paths.

U.S. Pat. No. 4,539,072 discloses an automatic decurling apparatus providing for webs of paper material in which two small diameter decurling bars are adjusted into both sides of the web run between two closely spaced rollers around which the Web passes in an S-wrap. The decurling bars can be independently adjusted into the web in varying degrees to compensate for predominant curl in one direction of the web.

U.S. Pat. No. 4,505,695 discloses a mechanism for decurling copy sheets exiting the fuser apparatus of a copier having a compliant belt of pliable material, a curling roller forming a penetration nip with the compliant belt, the penetration nip being adapted to curl sheets to such an amount as to over curl a sheet leaving the fuser apparatus. A decision gate is arranged and shaped to direct the sheet into one of two paths depending upon the degree of over curl. In one path, when slight curl is experienced, a curling device is arranged to compensate for the slight curl. In the other path, when a high degree of curl is present, a curling device is positioned to effect a high degree of reverse curl.

U.S. Pat. No. 4,475,896 discloses a rigid penetration roller forming a penetration nip with a compliant roller. The penetration nip is adapted to curl sheets of paper passing therethrough. Movable plates are positioned at the sheet exit side of the nip for controlling the angle of exit of the sheets from the nip. A rack and pinion mechanism is provided for adjusting the orientation of the exit plates.

U.S. Pat. No. 1,969,073 discloses a sheet decurler for straightening sheets that are creased or rolled in handling. The sheet moves through a set of conveyor belts/rollers to flatten the sheet.

In accordance with one aspect of the present invention, there is provided an apparatus for decurling a sheet having multiple curl conditions therein. The apparatus includes a first decurling member positionable to contact the sheet for removing a first curl condition therefrom and a second decurling member positionable to contact the sheet for removing a second curl condition therefrom, with the first decurling member and the second decurling member forming an extended multidirectional nip. The apparatus further includes a means for advancing the sheet along a sheet path through the multidirectional nip.

In accordance with another aspect of the present invention, there is provided a printing machine for printing indicia on sheets of the type including a decurler for decurling the sheets having multiple curl conditions therein. The printing machine includes a first decurling member positionable to contact the sheet for removing a first curl condition therefrom and a second decurling member positionable to contact the sheet for removing a second curl condition therefrom, with the first decurling member and the second decurling member forming an extended multidirectional nip. The printing machine further includes a means for advancing the sheet along a sheet path through the multidirectional nip.

The invention will be described in detail with reference to the following drawings, in which like reference numerals are used to refer to like elements. The various aspects of the present invention will become apparent as the following description proceeds and upon reference to the drawings, in which.

Figures 1, 1A:
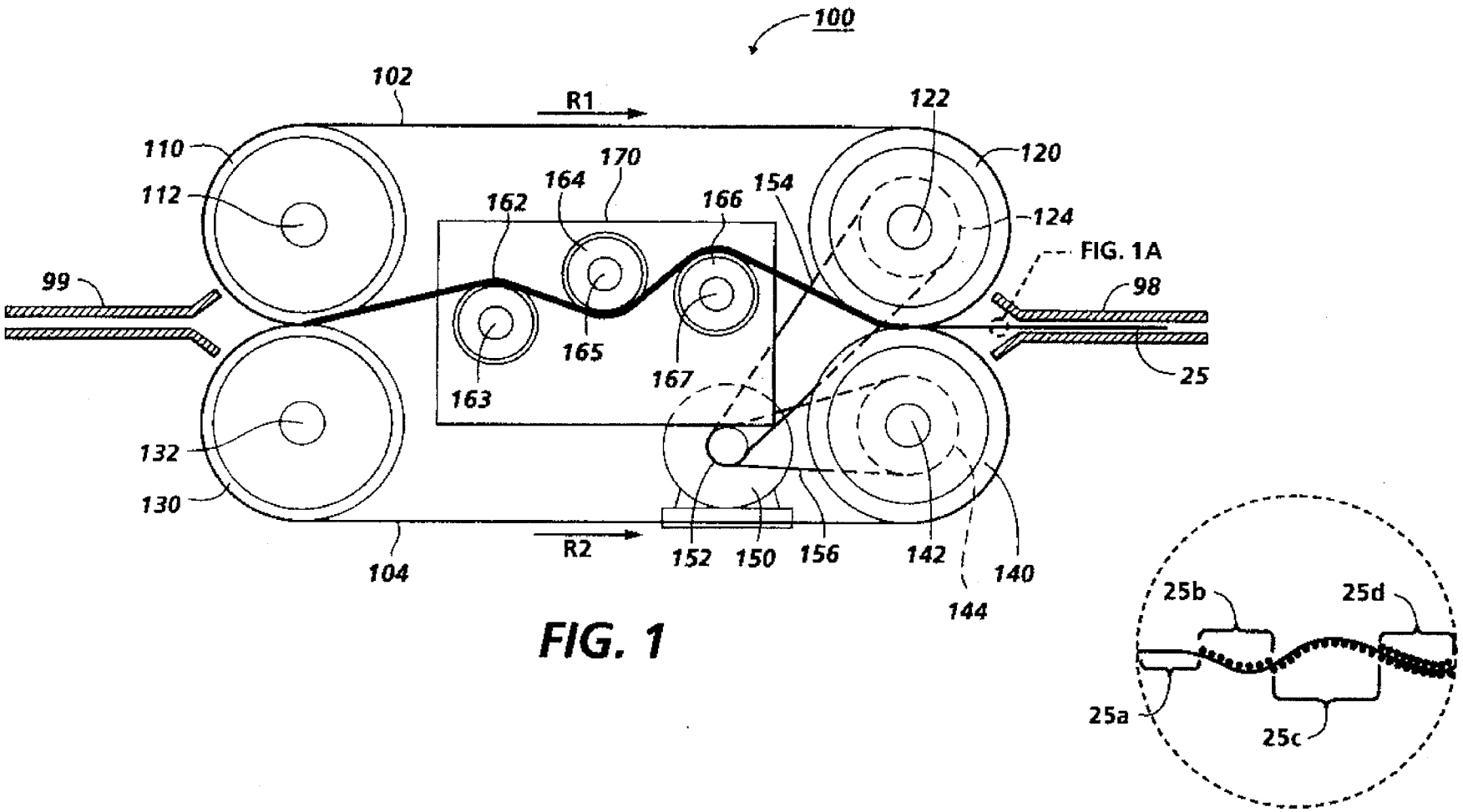
FIG. 1 is an elevational view of one embodiment of the sheet decurling assembly of the present invention.
FIG. 1A is an enlarged partial view of the sheet shown in FIG. 1.

While the present invention will hereinafter be described in connection with preferred embodiments, it will be understood that it is not intended to limit the invention to a particular embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing, copying and other systems, and are not necessarily limited in application to the particular systems shown herein.

Figure 9:
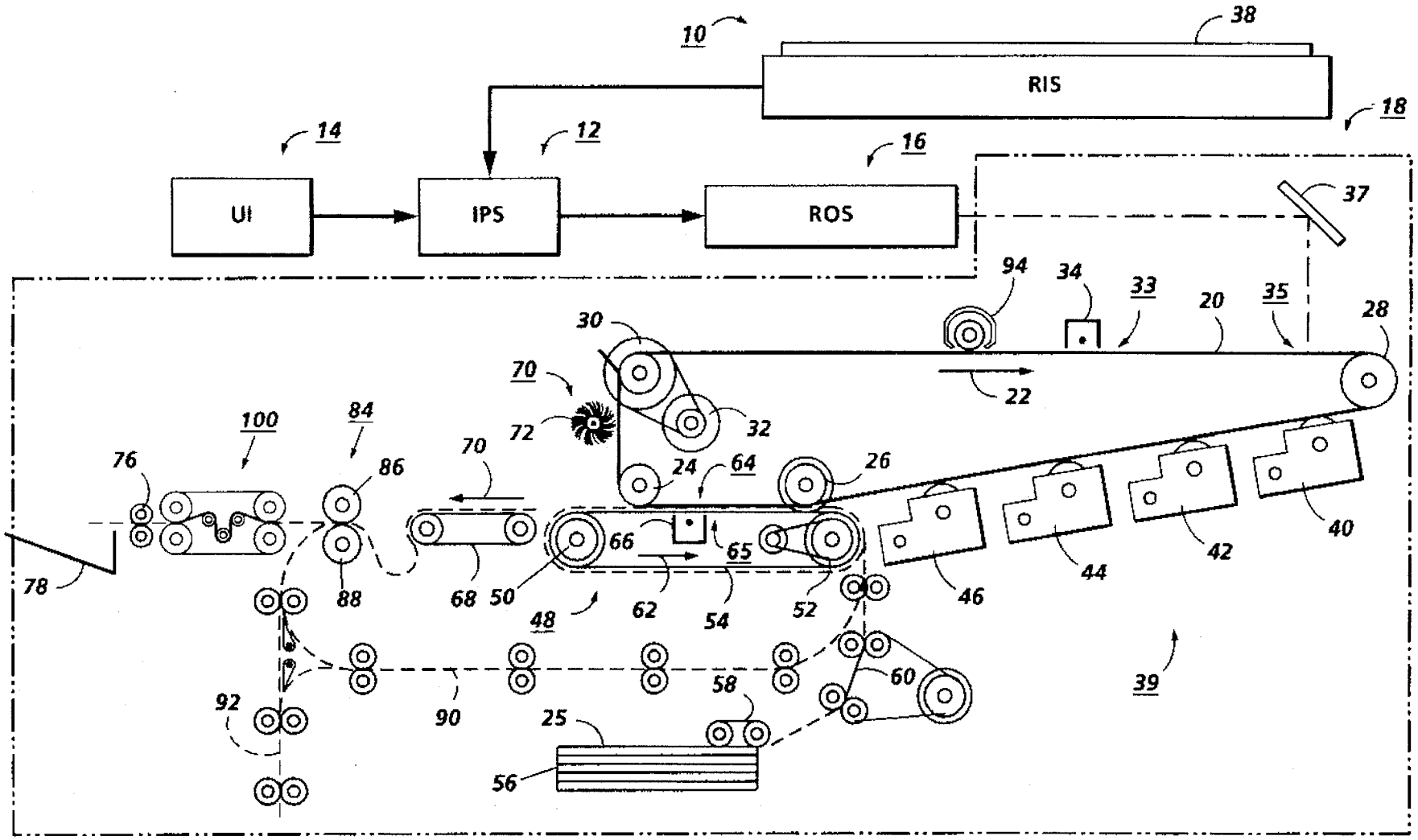
FIG. 9 is a schematic elevational view showing an exemplary color electrophotographic printing machine which may incorporate the features of the present invention therein.

To begin by way of general explanation, FIG. 9 is a schematic elevational view showing an electrophotographic printing machine which may incorporate features of the present invention therein. It will become evident from the following discussion that the present invention is equally well suited for use in a wide variety of copying and printing systems, and is not necessarily limited in its application to the particular system shown herein. As shown in FIG. 9, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e., red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three or four latent images which correspond to the signals transmitted from IPS 12. One latent image is developed with cyan developer material. Another latent image is developed with magenta developer material and the third latent image is developed with yellow developer material. A black latent image may be developed in lieu of or in addition to other/colored) latent images. These developed images are transferred to a copy sheet in superimposed registration with one another to form a multicolered image on the copy sheet. This multicolored image is then fused to the copy sheet forming a color copy.

With continued reference to FIG. 9, printer or marking engine 18 is an electrophotographic printing machine. Photoconductive belt 20 of marking engine 18 is preferably made from a photoconductive material. The photoconductive belt moves in the direction of arrow 22 to advance successive portions of the photoconductive surface sequentially through the various processing stations disposed about the path of movement thereof. Photoconductive belt 20 is entrained about rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt is exposed three or four times to record three or four latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the complement of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. During development of each electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 55 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 9) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e., a loading zone, to be received by the open sheet gripper. The sheet gripper then closes securing sheet 25 thereto for movement therewith in a recirculating path. The leading edge of sheet 25 is releasably secured by the sheet gripper. As belts 54 move in the direction of arrow 62, the sheet moves into contact with the photoconductive belt, in synchronism with the toner image developed thereon. In transfer zone 64, a gas directing mechanism (not shown) may direct a flow of gas onto sheet 25 to urge the sheet toward the developed toner image on photoconductive member 20 so as to enhance contact between the sheet and the developed toner image in the transfer zone. Further, in transfer zone 64, a corona generating device 66 sprays ions onto the backside of the sheet so as to charge the sheet to the proper magnitude and polarity for attracting the toner image from photoconductive belt 20 thereto. The beet remains secured to the sheet gripper so as to move in a recirculating path for three cycles. In this way, three or four different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, onto the sheet to form the multicolored copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 84, where the transferred toner image is permanently fused to the sheet. The fusing station includes heated fuser roll 86 and pressure roll 88. The sheet passes through the nip defined by rolls 86 and 88. After/or before) the fusing station, a recirculating document path 90 may return sheet 25 to a sheet side reversing device 92, and thereafter to sheet transport 48, for duplex printing on the other side of sheet 25, and thereafter for a second fusing of the second (duplex) toned image by fuser 84 (as described above).

After the fuser fixes the image to the sheet, decurler 100 (as described in greater detail in association with FIGS. 1 through 8) decurls the sheet. A one or two belt decurler that uses two or more penetrating rollers, shafts, baffles or "bends" in defining the mated decurler belt path attains the desired multiple bend wrap and flexing of the copy. The decurler of the present invention is particularly useful in duplex toned copies, when adjustable systems may be ineffective to combat varying direction and degree of curl that can switch directions across the surface of a duplex copy. The multiple penetrating shafts can eliminate in certain embodiments the need for adjustment in duplex or simplex print decurling, which may in any case be ineffective due to the various curl conditions that can exist in the process (sheet movement) and inboard/outboard directions across the sheet. Variations of decurlers of the present invention as may be employed with the FIG. 9 exemplary color electrophotographic printing machine are further described below. Thereafter, the sheet is advanced by a pair of rolls 76 to a catch tray 78 (or sorter, not shown in FIG. 9) for subsequent removal therefrom by the machine operator.

The final processing station in the direction of movement of belt 20, as indicated by arrow 22, is a photoreceptor cleaning apparatus, indicated generally by the reference numeral 70. A rotatably mounted fibrous brush 72 may be positioned in the cleaning station and maintained in contact with photoconductive belt 20 to remove residual toner particles remaining after the transfer operation. Thereafter, lamp 94 illuminates photoconductive belt 20 to remove any residual charge remaining thereon prior to the start of the next successive cycle.

FIG. 1 shows decurler 100 of the present invention employing a first set of rollers 110 opposed by rollers 130 and a second set of roller 120 opposed by roller 140. A sheet entry baffle 98 guides each sheet 25 into decurler 100; sheet 25 is decurled by following a path between belts 102 and 104, as described in detail below. Sheet exit baffle 99 guides decurled sheets 25 out of decurler 100. FIG. 1A shows a greatly enlarged view of a portion of sheet 25, and illustrates several sheet toned area and curling conditions that can require the use of the multilevel toned image sheet decurling apparatus of the present invention. Region **25*a* shows an untoned (uncurled) portion of sheet 25. Region 25*b* shows an upper side, single layer toned area, with a medium upwardly curled portion of sheet 25. Region 25*c* shows a lower side single layer toned area, with a medium downwardly curled portion of sheet 25. Region 25*d* shows duplex (first and second side) layered toned area, with a light upwardly curled portion of sheet 25. The various toned (powdered or liquid) layers and curling conditions across the surfaces of sheet 25** can make variable sheet area decurling difficult or impractical; in such cases, a single decurling path and system that can handle many if not all sheet curl possibilities, to include duplex and/or multilayer/color toned curled sheets is desirable.

With continued reference to FIG. 1, axle 112 holds roller 110, and is rotatably mounted on a bracket (:not shown); axle 122 holds roller 120, and is likewise rotatably mounted on a bracket (not shown). A set of decurler members, rollers 162, 164 and 166 are rotatably mounted, respectively, on axles 163, 165 and 167; axles 163, 165 and 167 are fixed to mounting plate 170. Rollers 162, 164, and 166 rotate freely in response to movement of belt 102 threaded thereby as shown, so as to form the extended multidirectional decurling nip for decurling the sheet. Belt 102 is thus entrained about rollers 110, 120, 162, 164 and 166 as shown. A motor 150 includes a drive pulley 152, for moving drive belt 154. A driven pulley 124 is mounted at one end of axle 122, such that drive belt 154 entrained about drive-pulley 152 and driven pulley 124 drives roller 120; belt 102 is thus driven about rollers 110, 120, 166, 164 and 162 in direction R1 as shown. Axle 132 holds roller 130, and is rotatably mounted on a bracket (not shown); axle 142 holds roller 140, and is likewise rotatably mounted on a bracket (not shown). Belt 104 is entrained as shown about rollers 130, 140, 162, 166 and 164 for decurling the sheet. A motor 150 includes a drive pulley 152, for moving drive belt 156. A driven pulley 144 is mounted at one end of axle 142, such that belt 156 entrained about drive pulley 152 and driven pulley 144 drives roller 140; belt 104 is thus driven about rollers 130, 140, 166, 164 and 162 in direction R2 as shown. In a preferred embodiment, the relative sheet wrap angle decreases as sheet 25 passes across roller 166, then 164, then 162. For example, the sheet (and belts 102 and 104) might wrap roller 166 for 80°, roller 164 for 50° and roller 162 for 30°. In this manner, sheet 25 may exit with minimum final curl, to include without curl induced by decurler 100.

Untoned area 25*a* (FIG. 1*a*) requires no decurling. Region 25*b* (FIG. 1*a*, upper side single layer toned area, with a medium upward curl) is decurled by the decurler path as that region passes around rollers 162 and 166 between belts 102 and 104. Region 25*c* (FIG. 1*a*, lower side single layer toned area, with a medium downward curl) is decurled by the decurler path as that region passes around roller 164 between belts 102 and 104. Region 25*d* (FIG. 1*a*, upper and lower side toned area, with a light upward curl) is also decurled by the decurler path as that region passes around rollers 162 and 166 between belts 102 and 104. In this manner, the various toned layers and curling conditions across the surfaces of sheet 25 have been dealt with by decurler 100. FIG. 1A shows only a few limited examples of possible sheet curl conditions, which may vary greatly depending on the sheets and toner (powdered, liquid, etc.) used.

Figures 2, 2A:
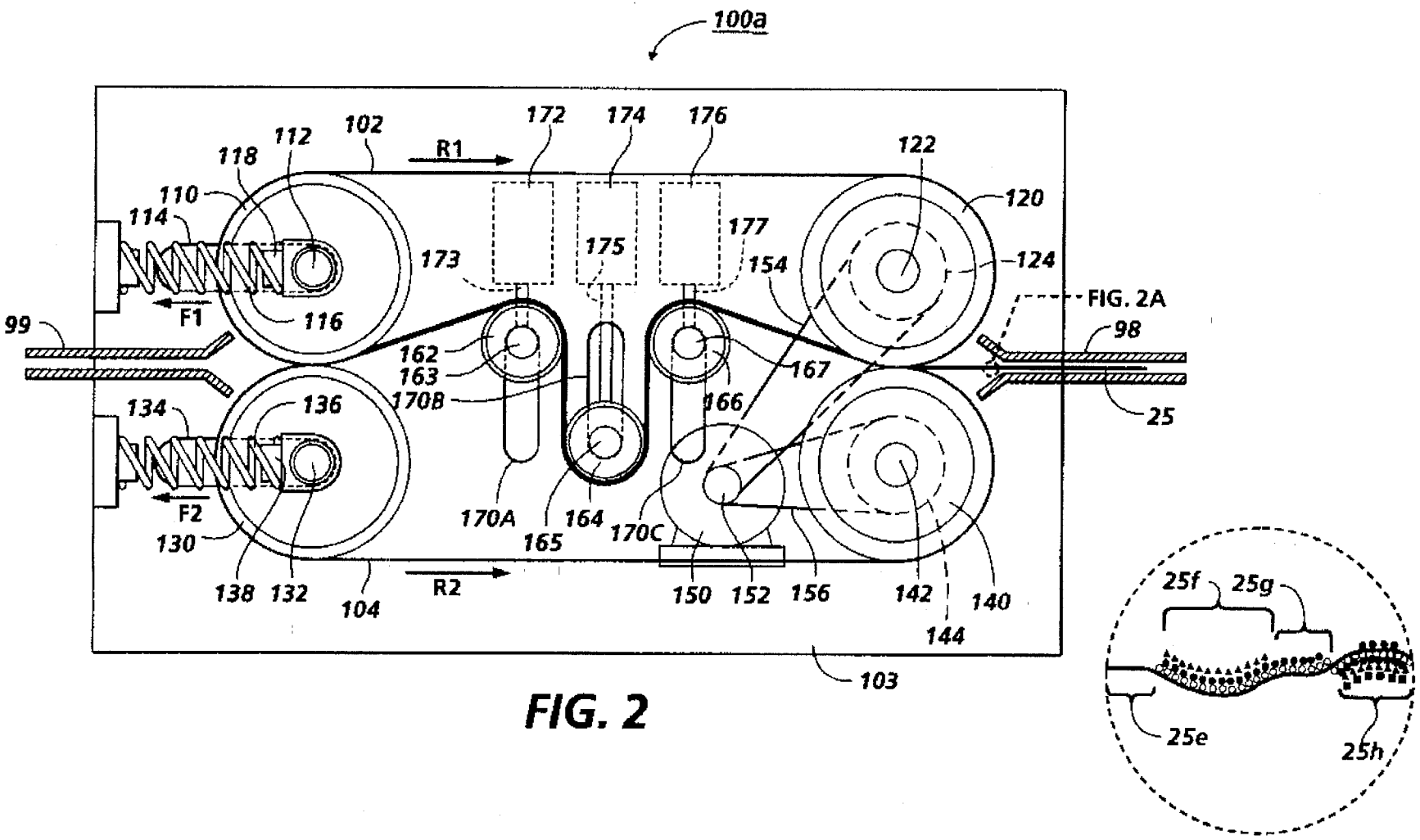
FIG. 2 is an elevation view of another embodiment of the sheet decurling assembly of the present invention.
FIG. 2A is an enlarged partial view of the sheet shown in FIG. 2.

FIG. 2 shows decurler 100a of the present invention. A sheet entry baffle 98 guides each sheet 25 into decurler 100*a;* sheet 25 is decurled by following a variable path between belts 102 and 104, as described in detail below. Sheet exit baffle 99 guides decurled sheets out of decurler 100. FIG. 2A shows a greatly enlarged view of a portion of sheet 25, and illustrates colored area and duplex curling conditions that can require the use of the multilevel toned image sheet decurling apparatus of the present invention. Region 25*e* shows an untoned and uncurled portion of sheet 25. Region 25*f* shows an upper side three layer toned area (such as with cyan, magenta and yellow toner layers), overlying a heavily upwardly curled portion of sheet 25. Region 25*g* shows an upper side, two layer toned area, with a medium upwardly curled portion of sheet 25. Region 25*h* shows duplex (first and second side) layered toned areas, with a heavy downwardly curled portion of sheet 25, caused by four lower surface layers of toner (such cyan, magenta, yellow and black) and one top layer of toner. FIG. 2 shows a variable sheet decurling path and system that can handle virtually any sheet curl conditions, to include duplex and/or multilayer/color toned curled sheets. FIG. 2A shows only a few further examples of possible sheet curl conditions, which again may vary greatly depending on fuser heat roll location, heat output and other fusing conditions as well as sheet and toner properties.

With continued reference to FIG. 2, axle 112 holds roller 110, and is rotatably mounted in a slot 114 on a sliding tension bracket 118. In one embodiment, a spring 116 is positioned within slot 114, attached at one end of slot 114 and at the other end to a sliding tension bracket 118, so as to maintain the desired tension on belt 102 in direction F1 as shown. (in certain embodiments, the decurler belts (such as 102 and 104) may be formed of an elastomeric material so as to maintain or assist in maintaining a desired tension range despite decurler roller movement.)

Axle 122 holds roller 120, and is likewise rotatably mounted on mounting bracket 103. A set of decurler members, rollers 162, 166 and 164 are rotatably mounted, respectively, on axles 163, 165 and 167. Axles 163, 165 and 167 slide, respectively, in slots 170A, 170B and 170C in mounting mounting bracket 103. Each solenoid 172 is connected by arm 173 to one end of axle 163, for variably positioning roller 162 in slot 170A. Each solenoid 174 is connected by arm 175 to one end of axle 165, for variably positioning roller 164 in slot 170B. Each solenoid 176 is connected by arm 177 to one end of axle 167, for variably positioning roller 166 in slot 170C. (in other embodiments, screw drives, and/or other electromechanical devices may be used to position rollers 162, 164 and/or 166 in slots 170A, 170B and 170C, respectively. Rollers 162, 166 and 164 rotate freely in response to movement of belt 102 threaded thereby as shown, so as to form the multilevel decurling path nips for decurling the sheet. Belt 102 is entrained about rollers 110, 120, 162, 166 and 164 as shown. A motor 150 includes a drive pulley 152, for moving drive belt 154. A driven pulley 124 is mounted at one end of axle 122, such that belt 154 entrained about drive pulley 152 and driven pulley 124 drives roller 120; belt 102 is thus driven about rollers 110, 120, 162, 166 and 164 in direction R1 as shown. In one embodiment, a spring 136 is positioned within slot 134, attached at one end of slot 134 and at the other end to a sliding tension bracket 138, so as to maintain the desired tension on belt 104 in direction F2 as shown. Axle 132 holds roller 130, and is rotatably mounted on sliding tension bracket 138 in slot 134. Axle 142 holds roller 140, and is likewise rotatably mounted on bracket 103. Belt 104 is entrained as shown about rollers 130, 140, 162, 166 and 164 for decurling the sheet. A motor 150 includes a drive pulley 152, for moving drive belt 156. A driven pulley 144 is mounted at one end of axle 142, such that belt 156 is entrained about drive pulley 152 and driven pulley 144 drives roller 140; belt 104 is thus driven about rollers 130, 140, 162, 166 and 164 in direction R2 as shown.

Untoned area 25*e* (FIG. 2*a*) requires no decurling. Region 25*f* (FIG. 2*a*, upper side, three layer toned area, with a heavy upward curl) is decurled by the decurler path as that region passes around rollers 162 and 166 between belts 102 and 104. Region 25*g* (FIG. 2*a*, upper side two layer toned area, with a medium upward curl) is also decurled by the decurler path as that region passes around roller 162 and 166 between belts 102 and 104. Region 25*h* (FIG. 2*a*, duplex printed sheet with an upper side, single layer toned area and a lower side four layer toned area, resulting in a heavy downward curl) is decurled by the decurler path as that region passes around roller 164 between belts 102 and 104. In this manner, the various toned layers and curling conditions across the regions 25*e* through 25*h* of sheet 25 have been dealt with by decurler 100*a*.

Figure 3A:
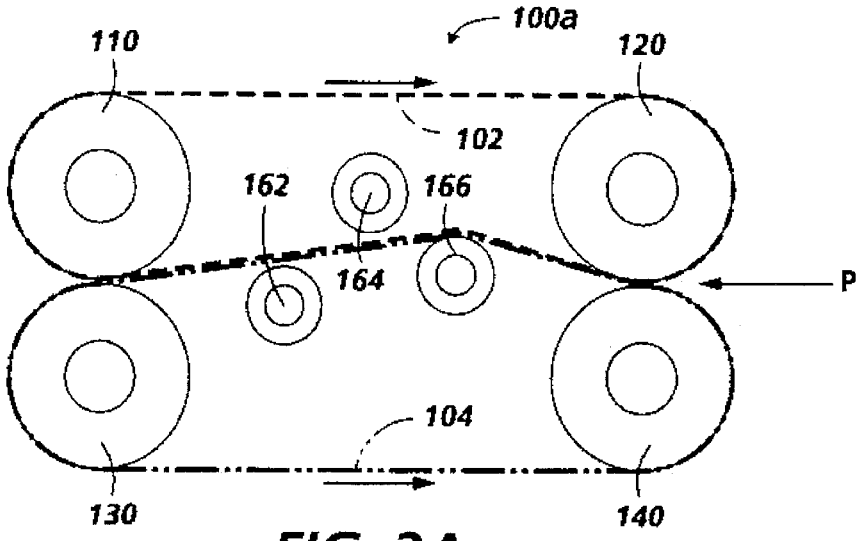
FIG. 3A is a schematic elevation view of an embodiment of the sheet decurler of the present invention.
Figure 3B:
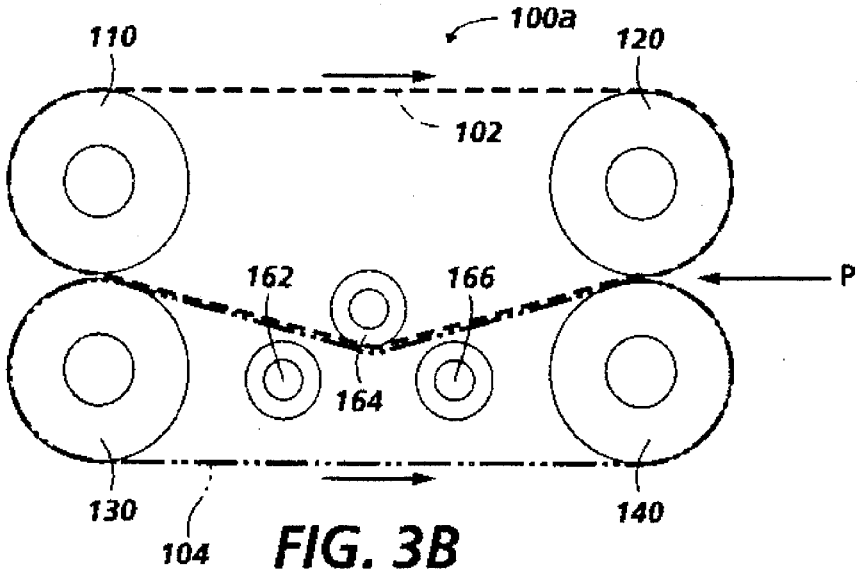
FIG. 3B is a schematic elevation view of the FIG. 3A embodiment of the sheet decurler of the present invention.
Figure 3C:
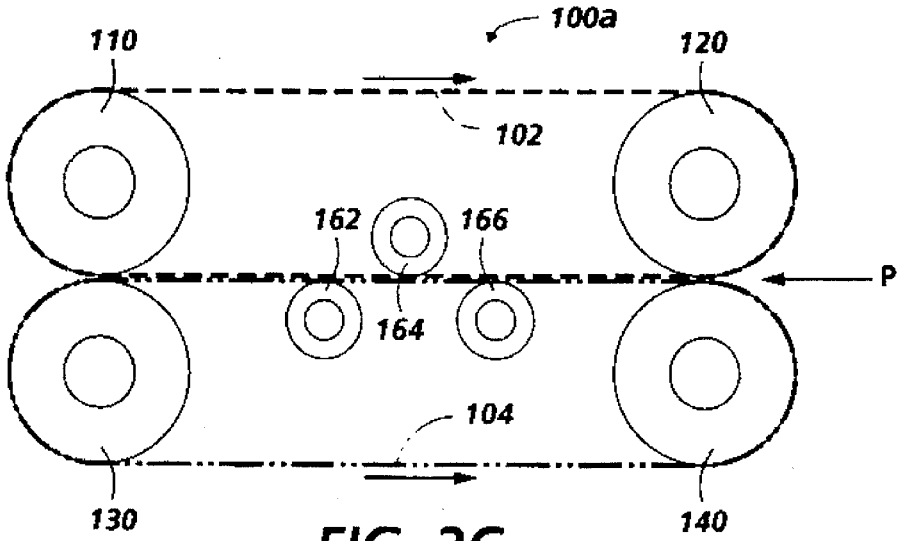
FIG. 3C is a schematic elevation view of the FIG. 3A embodiment of the sheet decurler of the present invention.

FIGS. 3A, 3B and 3C show schematic views of decurler roller and belt positioning of decurler 100*a* of the present invention. Additional decurler rollers (in addition to rollers 162, 164 and 166 as shown) may be employed according to the embodiments shown in FIGS. 1 and 2 herein, without departing from the spirit and scope of the present invention.

FIG. 3A shows a sheet entry path (direction P) wherein only decurler roller 166 of sheet decurler 100*a* engages the sheet, for decurling one-sided (upwardly) curled sheets. Decurler rollers 162 and 164 are positioned out of contact with belts 102 and 104 according to solenoids (FIG. 2). FIG. 3B shows a sheet entry path (direction P) wherein only decurler roller 164 of sheet decurler 100*a* engages the sheet, for decurling simplex of one-sided (downwardly) curled sheets. Decurler rollers 162 and 166 are positioned out of contact with belts 102 and 104 according to solenoids (FIG. 2). FIG. 3C shows a sheet entry path (direction P) wherein no decurler rollers of sheet decurler 100*a* engage the sheet, when decurling is not required. Decurler rollers 162, 164 and 166 are positioned out of or just in contact with belts 102 and 104 according to solenoids (FIG. 2).

Figure 4A:
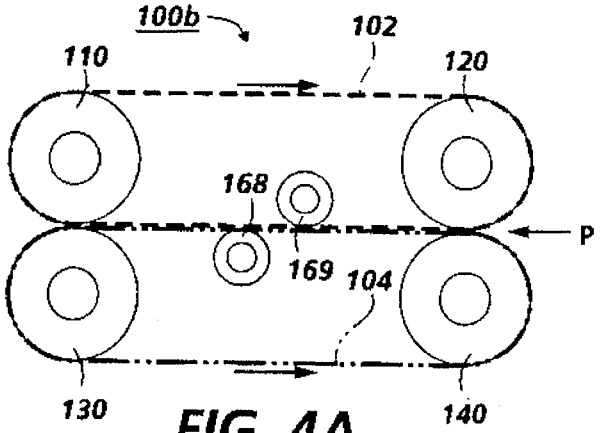
FIG. 4A is a schematic elevation view of an embodiment of the sheet decurler of the present invention.
Figure 4B:
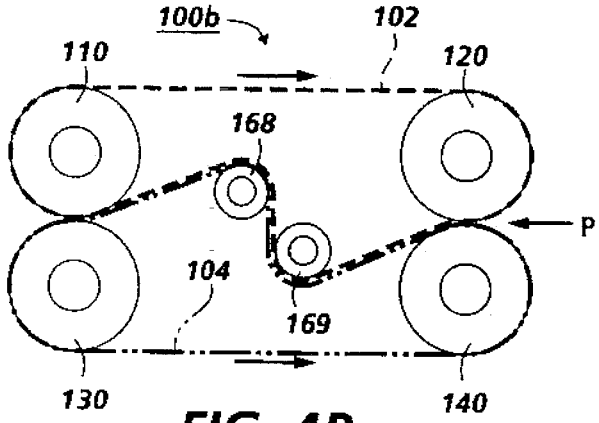
FIG. 4B is a schematic elevation view of the FIG. 4A embodiment of the sheet decurler of the present invention.

FIGS. 4A, 4B, 4C and 4D show schematic views of decurler roller and belt positioning of variable decurler 100*b* of the present invention. Decurler 100*b* includes only two decurler rollers (rollers 168 and 169 as shown) in the extended nip, variably employed according to the solenoid movement shown in FIG. 2. Alternatively, this two decurler roller system may be employed according to fixed (duplex) two direction extended nip decurler roller positioning as shown in FIG. 4B, minus the additional (third) decurler roller described in greater detail in association with the fixed decurler roller system decurler 100 shown in FIG. 1.

Figure 4C:
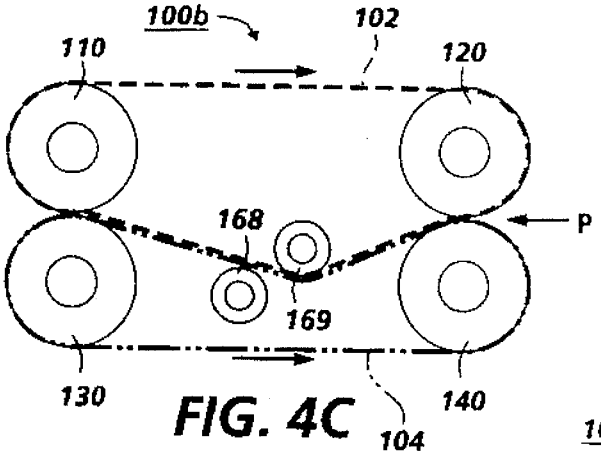
FIG. 4C is a schematic elevation view of the FIG. 4A embodiment of the sheet decurler of the present invention.
Figure 4D:
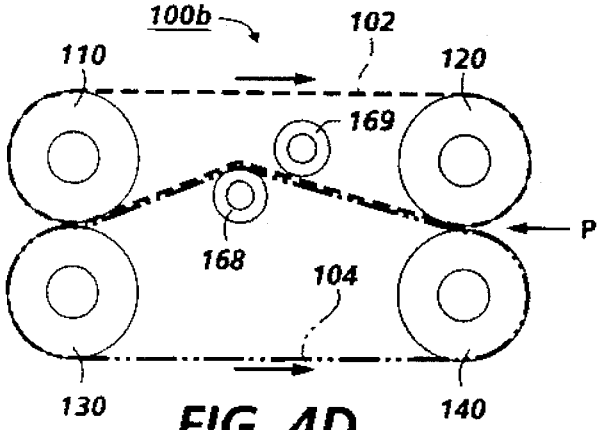
FIG. 4D is a schematic elevation view of the FIG. 4A embodiment of the sheet decurler of the present invention.

FIG. 4A shows a sheet entry path (direction P) wherein no decurler rollers of sheet decurler 100*b* engage the sheet, when decurling is not required. Decurler rollers 168 and 169 are positioned out of or just in contact with belts 102 and 104 according to solenoids (FIG. 2). FIG. 4B shows a sheet entry path (direction P) wherein both decurler rollers 168 and 169 of sheet decurler 100*b* engage the sheet, for decurling duplex, two-sided (upward and downward curled area) sheets. Decurler rollers 168 and 169 may be positioned according to solenoids (FIG. 2) or in fixed positions (FIG. 1). FIG. 4C shows a sheet entry path (direction P) wherein only decurler roller 169 of sheet decurler 100*b* engages the sheet, for decurling one-sided (downwardly) curled sheets. Decurler roller 168 is positioned out of contact with belts 102 and 104 according to solenoids (FIG. 2). FIG. 4D shows a sheet entry path (direction P) wherein only decurler roller 168 of sheet decurler 100*b* engages the sheet, for decurling simplex of one-sided (upwardly) curled sheets. Decurler roller 169 is positioned out of contact with belts 102 and 104 according to solenoids (FIG. 2).

Figure 5:
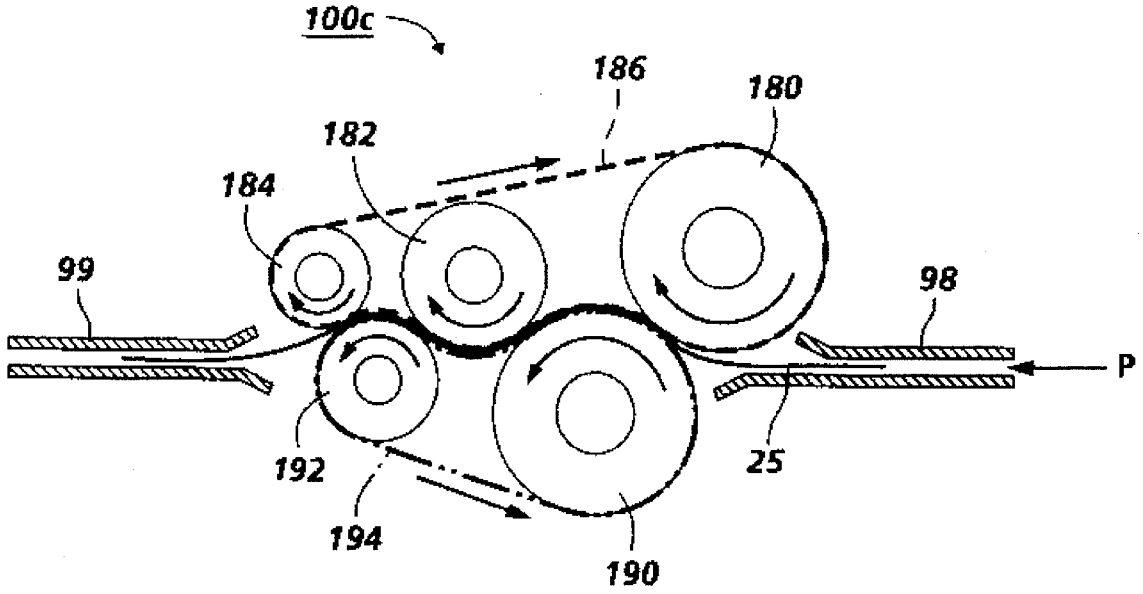
FIG. 5 is a schematic, elevation view of another embodiment of the sheet decurling assembly of the present invention.

FIG. 5 shows a schematic view of decurler roller and belt positioning of variable decurler 100c of the present invention. Decurler 100*c* includes three belt 186 path-defining rollers (rollers 180, 182 and 184) about which belt 186 is entrained. Rollers 180, 182 and 184 are sized in descending order, such that roller 182 is smaller in diameter than roller 180, and larger in diameter than roller 184. Decurler 100*c* further includes two belt path-defining rollers (rollers 190 and 192) about which belt 194 is entrained. Rollers 190 and 192 are also sized in descending order, such that roller 192 is smaller in diameter than roller 190. FIG. 5 shows a sheet entry path (direction P) through entry baffle 98. Sheet 25 is directed between belts 186 and 194 for simplex or duplex (upward and/or downward curled areas) on sheet 25. Descendingly sized rollers graduatingly engage the belts (and sheet therebetween) so as to decurl sheets in any curl condition. Belt to sheet traction may be improved as a result of the larger contact area made on the sheet by the larger rollers (180 and 190) early in the sheet path. Full (complete) decurling of heavily or radically curled sheets is completed by the smaller rollers (182, 192, 184) as the sheet approaches the end of the sheet decurling path and exits into sheet exit baffle 99 as shown. Duplex decurling occurs in phases, at roller 180/190 nip initially and over the roller 182 circumference for more advanced or radical downward curl sheet decurling. Upward sheet curl decurling also occurs in phases, over the roller 190 circumference initially and over the smaller roller 192 circumference for more advanced or radical decurling. FIG. 5 shows rollers 180, 182, 184, 190 and 192 in fixed position; alternatively, one or more of these rollers may be positioned according to solenoid(s) such as those shown and described in the variable roller position system of FIG. 2.

Figure 6A:
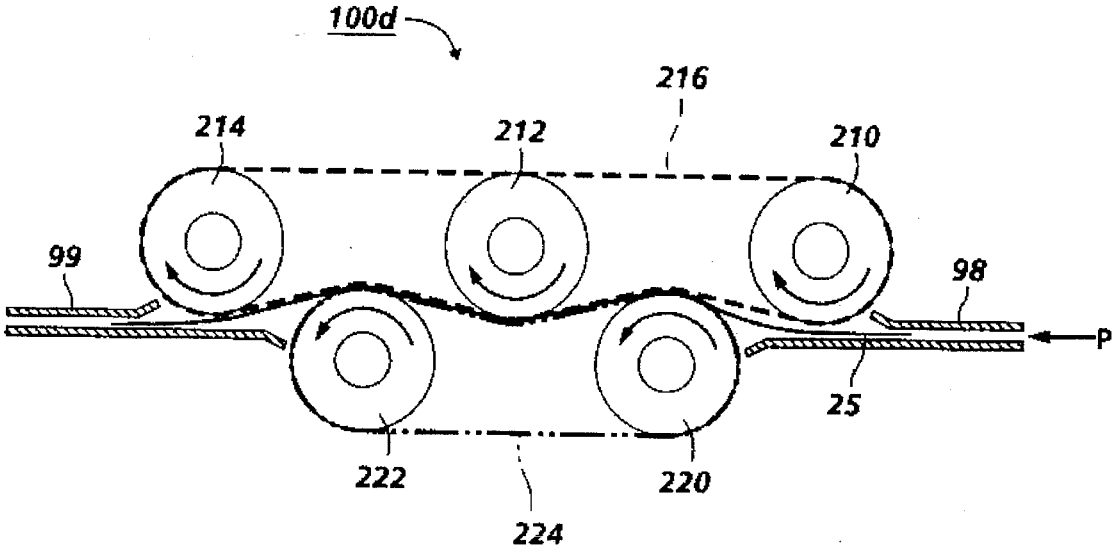
FIG. 6A is a schematic elevation view of an embodiment of the sheet decurler of the present invention.
Figure 6B:
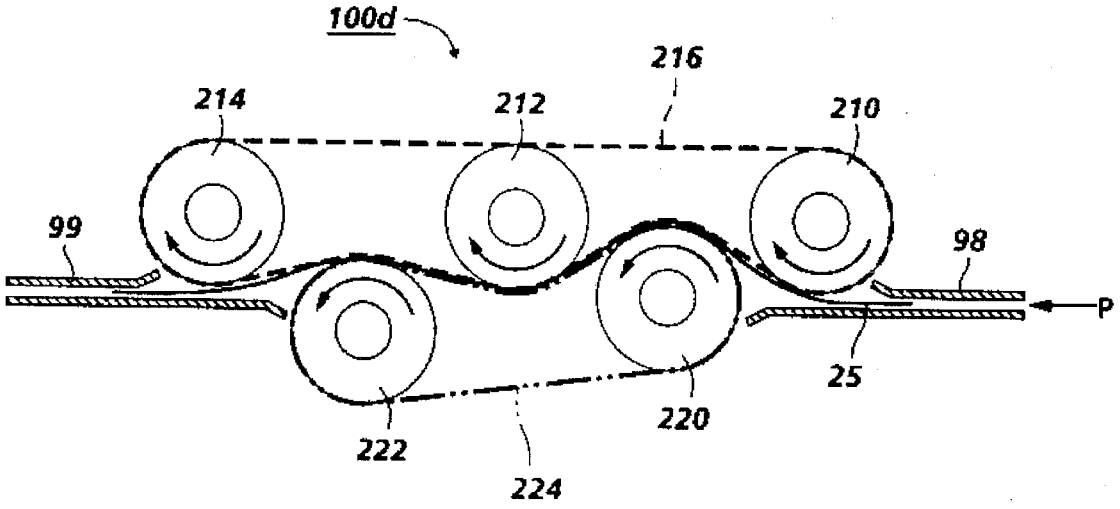
FIG. 6B is a schematic elevation view of the FIG. 6A embodiment of the sheet decurler of the present invention.

FIG. 6A and 6B show schematic views of decurler roller and belt positioning of variable decurler 100*d* of the present invention. Decurler 100*d* includes three belt path-defining rollers (rollers 210, 212 and 214) about which belt 216 is entrained. Decurler 100*d* further includes two belt path-defining rollers (rollers 220 and 222) about which belt 224 is entrained. FIG. 6A shows a sheet entry path (direction P) through entry baffle 98. Sheet 25 is directed between belts 216 and 224 for light to medium duplex (upwardly and downwardly curled areas) on sheet 25. FIG. 6B shows another schematic view of decurler roller and belt positioning of variable decurler 100*d*, in which roller 220 has been raised for more radical decurling of sheet 25 having medium to heavy upwardly curled areas. The FIG. 6A and 6B roller 220 (and others) may alternatively be positioned according to solenoid(s) such as those shown and described in the variable roller position system of FIG. 2.

Figure 7A:
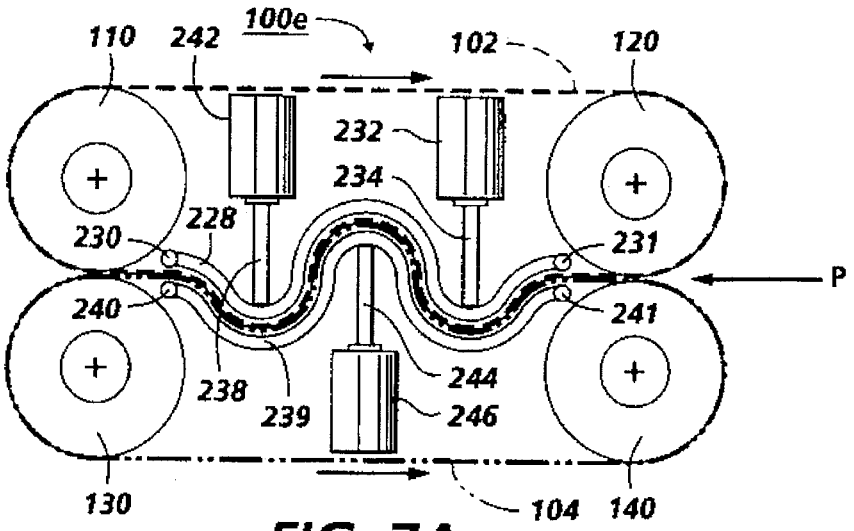
FIG. 7A is a schematic elevation view of an embodiment of the sheet decurler of the present invention.
Figure 7B:
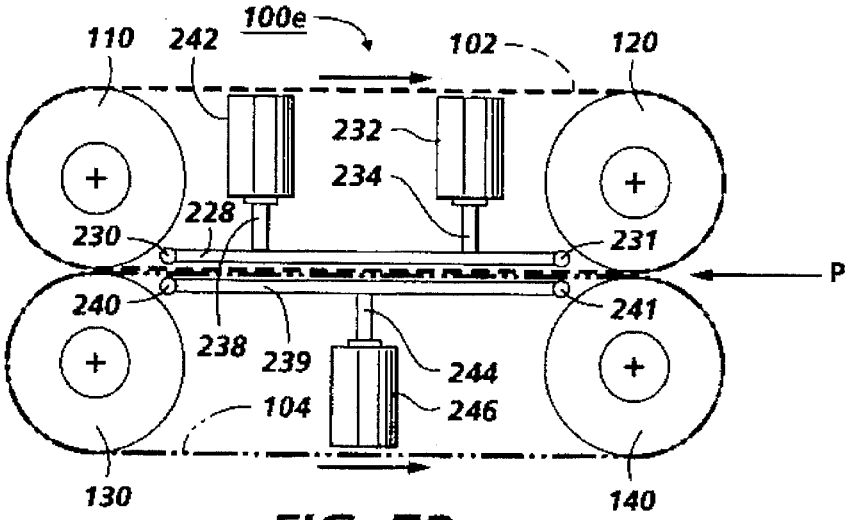
FIG. 7B is a schematic elevation view of the FIG. 7A embodiment of the sheet decurler of the present invention.
Figure 7C:
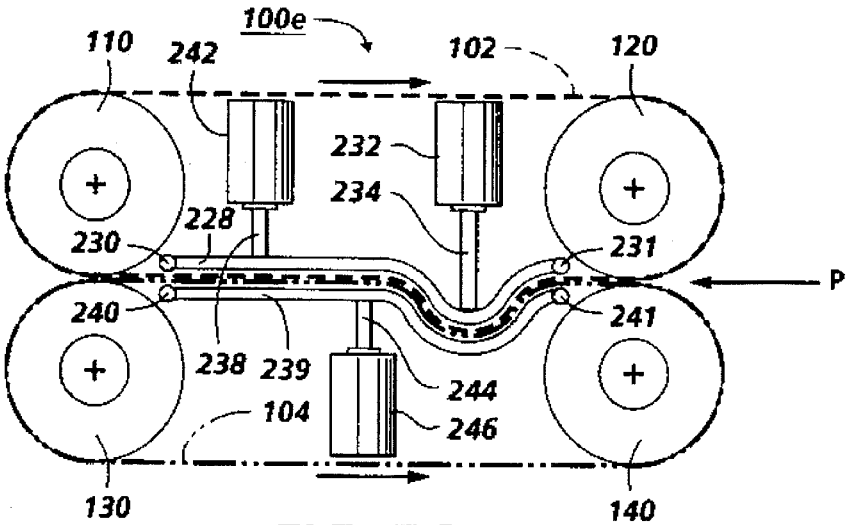
FIG. 7C is a schematic elevation view of the FIG. 7A embodiment of the sheet decurler of the present invention.

FIGS. 7A, 7B and 7C show schematic views of decurler roller and belt positioning of variable decurler 100*e* of the present invention. Decurler 100*e* includes two belt path-defining rollers (rollers 110 and 120) about which belt 102 is entrained. Decurler 100*e* further includes two belt path-defining rollers (rollers 130 and 140) about which belt 104 is entrained. FIGS. 7A–7C show a sheet entry path (direction P), through which a sheet (not shown) is directed between belts 102 and 104. A flexible, elastomeric baffle 228 is anchored at one end at a pin 230 and at the other end at a pin 231. Solenoids 232 and 242 are connected to baffle 228, respectively, by arms 234 and 238, for variably positioning baffle 228 such as shown in FIGS. 7A, 7B and 7C. A second flexible, elastomeric baffle 239 is anchored at one end at a pin 240 and at the other end at a pin 241. Solenoid 246 is connected to baffle 239 by arm 244, for variably positioning baffle 239 such as shown in FIGS. 7A, 7B and 7C. Baffles 228 and 239 each include a low friction surface for permitting the belt to pass with minimal drag. The FIG. 7A baffles 228 and 239 may alternatively be fixed in position for all modes of decurling, such as in the fixed roller positioning system of FIG. 1.

Figure 8:
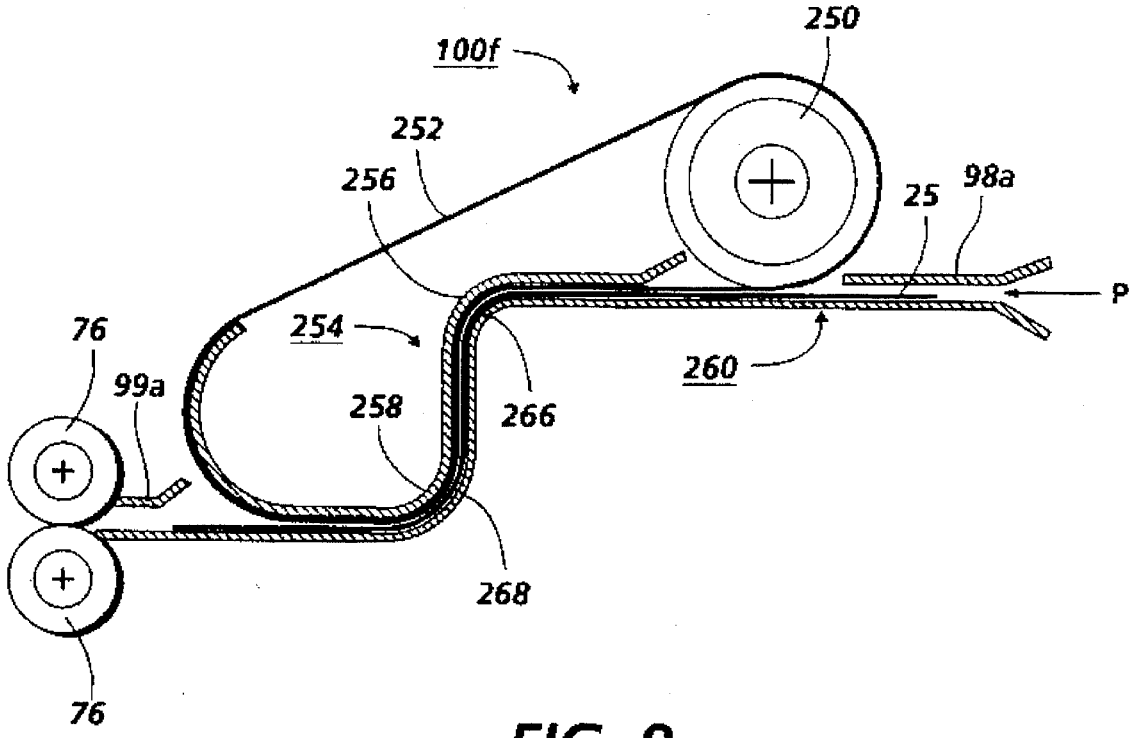
FIG. 8 is a schematic elevation view of another embodiment of the sheet decurling assembly of the present invention.

FIG. 8 shows a schematic view of decurler roller and belt positioning of variable decurler 100*f* of the present invention. Decurler 100*f* includes a belt 252, a drive roller 250 and a path-defining curved baffle 254 about which belt 252 is entrained. Decurler 100*f* further includes path-defining curved baffle 260 for maintaining the required decurling nips opposite moving belt 252. Path-defining curved baffles 254 and 260 include low friction surfaces for permitting the belt and/or sheet to pass with minimal drag. FIG. 8 shows a sheet 25 entry path (direction P) under an entry baffle 98*a*. Sheet 25 is directed between belt 252 and baffle 260 for simplex or duplex decurling of upwardly and/or downwardly curled areas on sheet 25. Single drive/path-defining roller 250 propels belt 252, which is backed by and slides across the low-friction surface of baffle 254, and pulls sheet 25 through the decurling path. Belt 252 to sheet 25 traction is maintained as the sheet passes across decurling curves 256 and 258 of baffle 254, as well as across opposing curves 266 and 268 of baffle 260. After sheet 25 has negotiated the decurling path, sheet 25 exits into sheet exit baffle 99*a* as shown, to be advanced by pair of rolls 76 to a catch tray or sorter (not shown). While other embodiments (FIGS. 1 through 7C) show a decurler which includes two belt transports having penetrating roller shafts, a single belt 252 and single drive roller 250 can guide a sheet through a set of baffles to provide the multiple bend wrap and flexing of the copy, to reduce or eliminate its curl. Other decurling rollers, shafts, rods, guides, baffles and other means of flexing a sheet moving along a sheet path may likewise be employed in accordance with the present invention to reduce or eliminate curl in prints having both toward image and away from image curl in a single pass without (or with) adjustment.

Various embodiments of a multilevel/color toned, simplex or duplex printed sheet decurling system have been described. While the present invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. An apparatus for decurling a sheet having multiple curl conditions therein, comprising:

a first decurling member positionable to contact the sheet for removing a first curl condition therefrom;

a second decurling member positionable to contact the sheet for removing a second curl condition therefrom, said first decurling member and said second decurling member forming an extended multidirectional nip; and means for advancing the sheet along a sheet path through the multidirectional nip.

2. The apparatus of claim 1, wherein said advancing means comprises a first belt for contacting a first side of the sheet.

3. The apparatus of claim 2, wherein said advancing means comprises a second belt for contacting a second side of the sheet.

4. The apparatus of claim 3, wherein said second decurling member comprises a roller for directing said second belt into contact with the second side of the sheet.

5. The apparatus of claim 2, wherein said first decurling member comprises a roller for directing said first belt into contact with the first side of the sheet.

6. The apparatus of claim 1, wherein:

said first decurling member includes a first arcuate portion for bending the sheet in a first direction; and said second decurling member includes a second arcuate portion for bending the sheet in a second direction opposed from the first direction.

7. The apparatus of claim 1, further comprising a third decurling member positionable in the multidirectional nip to contact the sheet for removing a third curl condition therefrom.

8. An apparatus for decurling a sheet having multiple curl conditions therein, comprising:

a first decurling member positionable to contact the sheet for removing a first curl condition therefrom wherein said first decurling member comprises a first baffle for directing a first belt into contact with a first side of the sheet;

a second decurling member positionable to contact the sheet for removing a second curl condition therefrom, said first decurling member and said second decurling member forming an extended multidirectional nip; and means for advancing the sheet along a sheet path through the multidirectional nip wherein said advancing means comprises said first belt for contacting said first side of the sheet.

9. An apparatus for decurling a sheet having multiple curl conditions therein, comprising:

a first decurling member positionable to contact the sheet for removing a first curl condition therefrom;

a second decurling member positionable to contact the sheet for removing a second curl condition therefrom, said first decurling member and said second decurling member forming an extended multidirectional nip wherein said second decurling member comprises a baffle for directing a second belt into contact with a second side of the sheet; and means for advancing the sheet along a sheet path through the multidirectional nip wherein said advancing means comprises a first belt for contacting a first side of the sheet and said second belt for contacting said second side of the sheet.

10. An apparatus for decurling a sheet having multiple curl conditions therein, comprising:

a first decurling member positionable to contact the sheet for removing a first curl condition therefrom, wherein said first decurling member bends the sheet at a positive angle relative to a sheet path; a second decurling member positionable to contact the sheet for removing a second curl condition therefrom, said first decurling member and said second decurling member forming an extended multidirectional nip wherein said second decurling member bends the sheet at a negative angle relative to the sheet path with the positive angle being of a greater magnitude than the negative angle; and means for advancing the sheet along the sheet path through the multidirectional nip.

11. An apparatus for decurling a sheet having multiple curl conditions therein, comprising:

a first decurling member positionable to contact the sheet for removing a first curl condition therefrom wherein said first decurling member bends the sheet at a first angle relative to a sheet path;

a second decurling member positionable to contact the sheet for removing a second curl condition therefrom, said first decurling member and said second decurling member forming an extended multidirectional nip, wherein said second decurling member bends the sheet at a second angle relative to the sheet path;

means for variably positioning said first and second decurling members so as to alter said first and second angles; and means for advancing the sheet along the sheet path through the multidirectional nip.

12. An apparatus for decurling a sheet having multiple curl conditions therein, comprising:

a first decurling member positionable to contact the sheet for removing a first curl condition therefrom wherein said first decurling member bends the sheet at a positive angle relative to a sheet path;

a second decurling member positionable to contact the sheet for removing a second curl condition therefrom, said first decurling member and said second decurling member forming an extended multidirectional nip wherein said second decurling member bends the sheet at a negative angle relative to the sheet path with the positive angle being of a greater magnitude than the negative angle;

a third decurling member positionable in the multidirectional nip to contact the sheet for removing a third curl condition therefrom whereby said third decurling member bends the sheet at a second positive angle relative to the sheet path with the second positive angle having a lesser absolute value than the negative angle; and means for advancing the sheet along a sheet path through the multidirectional nip.

13. A printing machine for printing indicia on sheets of the type including a decurler for decurling a sheet having multiple curl conditions therein, comprising:

an extended multidirectional nip including a first decurling member positionable to contact the sheet for removing a first curl condition therefrom and a second decurling member positionable to contact the sheet for removing a second curl condition therefrom; and means for advancing the sheet along a sheet nip path including said first decurling member and said second decurling member.

14. The printing machine of claim 13, wherein said advancing means comprises a first belt for contacting a first side of the sheet.

15. The printing machine of claim 14, wherein said advancing means comprises a second belt for contacting a second side of the sheet.

16. The printing machine of claim 15, wherein said second decurling member comprises a roller for directing said second belt into contact with the second side of the sheet.

17. The printing machine of claim 14, wherein said first decurling member comprises a roller for directing said first belt into contact with the first side of the sheet.

18. The printing machine of claim 13, wherein:

said first decurling member includes a first arcuate portion for bending the sheet in a first direction; and said second decurling member includes a second arcuate portion for bending the sheet in a second direction opposed from the first direction.

19. The printing machine of claim 13, further comprising a third decurling member positionable in the multidirectional nip to contact the sheet for removing a third curl condition therefrom.

20. A printing machine for printing indicia on sheets of the type including a decurler for decurling a sheet having multiple curl conditions therein, comprising:

an extended multidirectional nip including a first decurling member positionable to contact the sheet for removing a first curl condition therefrom wherein said first decurling member comprises a first baffle for directing a first belt into contact with a first side of the sheet and a second decurling member positionable to contact the sheet for removing a second curl condition therefrom; and means for advancing the sheet along a sheet path including said first decurling member and said second decurling member wherein said advancing means comprises said first belt for contacting said first side of the sheet.

21. A printing machine for printing indicia on sheets of the type including a decurler for decurling a sheet having multiple curl conditions therein, comprising:

an extended multidirectional nip including a first decurling member positionable to contact the sheet for removing a first curl condition therefrom and a second decurling member positionable to contact the sheet for removing a second curl condition therefrom wherein said second decurling member comprises a second baffle for directing a second belt into contact with a second side of the sheet; and means for advancing the sheet along a sheet path including said first decurling member and said second decurling member wherein said advancing means comprises a first belt for contacting a first side of the sheet and said second belt for contacting said second side of the sheet.

22. A printing machine for printing indicia on sheets of the type including a decurler for decurling a sheet having multiple curl conditions therein, comprising;

an extended multidirectional nip including a first decurling member positionable to contact the sheet for removing a first curl condition therefrom wherein said first decurling member bends the sheet at a positive angle relative to a sheet path, and a second decurling member positionable to contact the sheet for removing a second curl condition therefrom wherein said second decurling member bends the sheet at a negative angle relative to the sheet path with the positive angle being of a greater magnitude than the negative angle; and means for advancing the sheet along the sheet path including said first decurling member and said second decurling member.

23. A printing machine for printing indicia on sheets of the type including a decurler for decurling a sheet having multiple curl conditions therein, comprising; an extended multidirectional nip including a first decurling member positionable to contact the sheet for removing a first curl condition therefrom wherein said first decurling member bends the sheet at a first angle relative to a sheet path and a second decurling member positionable to contact the sheet for removing a second curl condition therefrom wherein said second decurling member bends the sheet at a second angle relative to the sheet path;

means for advancing the sheet along the sheet nip path including said first decurling member and said second decurling member; and means for variably positioning said first and second decurling members so as to alter said first and second angles.

24. A printing machine for printing indicia on sheets of the type including a decurler for decurling a sheet having multiple curl conditions therein, comprising;

an extended multidirectional nip including a first decurling member positionable to contact the sheet for removing a first curl condition therefrom wherein said first decurling member bends the sheet at a first angle relative to a sheet path, a second decurling member positionable to contact the sheet for removing a second curl condition therefrom wherein said second decurling member bends the sheet at a second angle relative to the sheet path and a third decurling member positionable in the multidirectional nip to contact the sheet for removing a third curl condition therefrom, whereby said third decurling member bends the sheet at a second positive angle relative to the sheet nip path with the second positive angle having a lesser absolute value than the negative angle;

means for advancing the sheet along the sheet path including said first decurling member and said second decurling member; and means for variably positioning said first and second decurling members so as to alter said first and second angles.

25. A printing machine for printing indicia on sheets of the type including a decurler for decurling a sheet having multiple curl conditions therein wherein the sheet includes at least one layer of toner variably applied to a first side of the sheet and at least one layer of toner variably applied to a second side of the sheet, comprising:

an extended multidirectional nip including a first decurling member positionable to contact the sheet for removing a first curl condition therefrom wherein said first decurling member bends the sheet at a first angle relative to a sheet path, a second decurling member positionable to contact the sheet for removing a second curl condition therefrom wherein said second decurling member bends the sheet at a second angle relative to the sheet path and a third decurling member positionable in the multidirectional nip to contact the sheet for removing a third curl condition therefrom, whereby said third decurling member bends the sheet at a second positive angle relative to the sheet path with the second positive angle having a lesser absolute value than the negative angle;

means for advancing the sheet along the sheet path including said first decurling member and said second decurling member; and means for variably positioning said first and second decurling members so as to alter said first and second angles.

* * * * *